US009318834B2

(12) United States Patent
Hsu et al.

(10) Patent No.: US 9,318,834 B2
(45) Date of Patent: Apr. 19, 2016

(54) LINKAGE MECHANISM FOR FOLDING POWER PLUG BLADES

(71) Applicant: POWERTECH INDUSTRIAL CO., LTD., New Taipei (TW)

(72) Inventors: Jung-Hui Hsu, New Taipei (TW); Yi-Chun Chen, Taipei (TW)

(73) Assignee: POWERTECH INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 14/450,227

(22) Filed: Aug. 2, 2014

(65) Prior Publication Data

US 2015/0229061 A1 Aug. 13, 2015

(30) Foreign Application Priority Data

Feb. 12, 2014 (TW) ..... 103104607 A

(51) Int. Cl.
*H01R 13/44* (2006.01)
*H01R 24/68* (2011.01)
*H01R 103/00* (2006.01)

(52) U.S. Cl.
CPC ..... *H01R 13/44* (2013.01); *H01R 24/68* (2013.01); *H01R 2103/00* (2013.01)

(58) Field of Classification Search
CPC ..... H01R 13/44–35/04
USPC ..... 439/131
See application file for complete search history.

(56) References Cited

U.S. PATENT DOCUMENTS

| | | | | |
|---|---|---|---|---|
| 6,241,538 | B1 * | 6/2001 | Chen | H01R 13/71 439/131 |
| 7,938,653 | B2 * | 5/2011 | Hopwood | H01R 24/28 439/131 |
| 8,712,486 | B2 * | 4/2014 | Sorias | H02J 7/0042 439/131 |
| 9,088,670 | B2 * | 7/2015 | Sorias | B25G 3/18 |
| 9,130,384 | B2 * | 9/2015 | Pliner | H02J 7/0042 |

FOREIGN PATENT DOCUMENTS

| | | |
|---|---|---|
| CN | 200983450 Y | 11/2007 |
| TW | 453552 | 9/2001 |
| TW | 541768 | 7/2003 |
| TW | 201345058 A | 11/2013 |

* cited by examiner

*Primary Examiner* — Vanessa Girardi
(74) *Attorney, Agent, or Firm* — Li & Cai Intellectual Property (USA) Office

(57) ABSTRACT

A power plug device includes a casing, a first prong, a second prong, and a linkage mechanism. The first and second prongs are pivotally arranged in a receiving recess of the casing. The linkage mechanism includes a linkage member, a first link, and a second link. A first end of the first link and a first end of the second link are respectively connected to the first and second prongs. A second end of the first link and a second end of the second link are both disposed in a guiding groove of the linkage member. When the first prong rotates, the second end of the first link can move in the guiding groove to drive the second end of the second link through the linkage member to move inversely in the guiding groove, such that the second prong rotates inversely with respect to the first prong.

11 Claims, 13 Drawing Sheets

LINKAGE MECHANISM FOR FOLDING POWER PLUG BLADES

BACKGROUND OF THE INVENTION

1. Field of the Invention

The present disclosure relates to a power plug device and a linkage mechanism thereof; in particular, to a power plug having interactive prongs and a linkage mechanism thereof.

2. Description of Related Art

Traditional plugs usually have parallel prongs protruding from plug casings for plugging to power sockets and electrically connecting thereto. However, the above design increases the overall volume of the plugs and is not convenient for storage. Common storage solutions for plugs involve pivotally connecting the prongs to an accommodating space of a plug casing, and rotating the parallel prongs abreast and side-by-side to protrude from the plug casing for plugging to power sockets, or rotating the parallel prongs abreast and side-by-side to an accommodating space of the plug casing so as to be stored. However, the above design require sufficient accommodating space provided by the plug casing to accommodate parallel prongs, and is therefore not conducive to reducing the overall dimensions of the plug structure.

SUMMARY OF THE INVENTION

An embodiment of the present disclosure provides a power plug device, comprising a casing, a first prong, a second prong and a linkage mechanism. The outer face of the casing is formed with a receiving recess. The first prong and the second prong are each pivotally arranged in the casing such that the first prong and the second prong each can be rotated to be accommodated in the receiving recess. The linkage mechanism is disposed in the casing and includes a linkage member, a first link and a second link. The linkage member has a guiding groove. A first end of the first link is fixed to the base of the first prong, and a second end of the first link is disposed in the guiding groove. A first end of the second link is fixed to the base of the second prong, and a second end of the second link is disposed in the guiding groove. When the first prong rotates with respect to the casing, the second end of the first link slides in the guiding groove and through the linkage member drives the second end of the second link to slide in the guiding groove in the direction opposite to the sliding direction of the second end of the first link, such that the second prong and the first prong rotate in opposite directions.

The power plug device provided by an embodiment of the present disclosure uses the linkage mechanism to drive the second prong to rotate in the opposite direction as the first prong when the first prong rotates. By this configuration, a user can raise or lower one of the prongs to cause the other prong to also be raised or lowered, respectively, so as to store the two prongs of the power plug device in an open or closed position.

In order to further the understanding regarding the present disclosure, the following embodiments are provided along with illustrations to facilitate the disclosure of the present disclosure.

DETAILED DESCRIPTION OF THE PREFERRED EMBODIMENTS

First Embodiment

Figure 1:
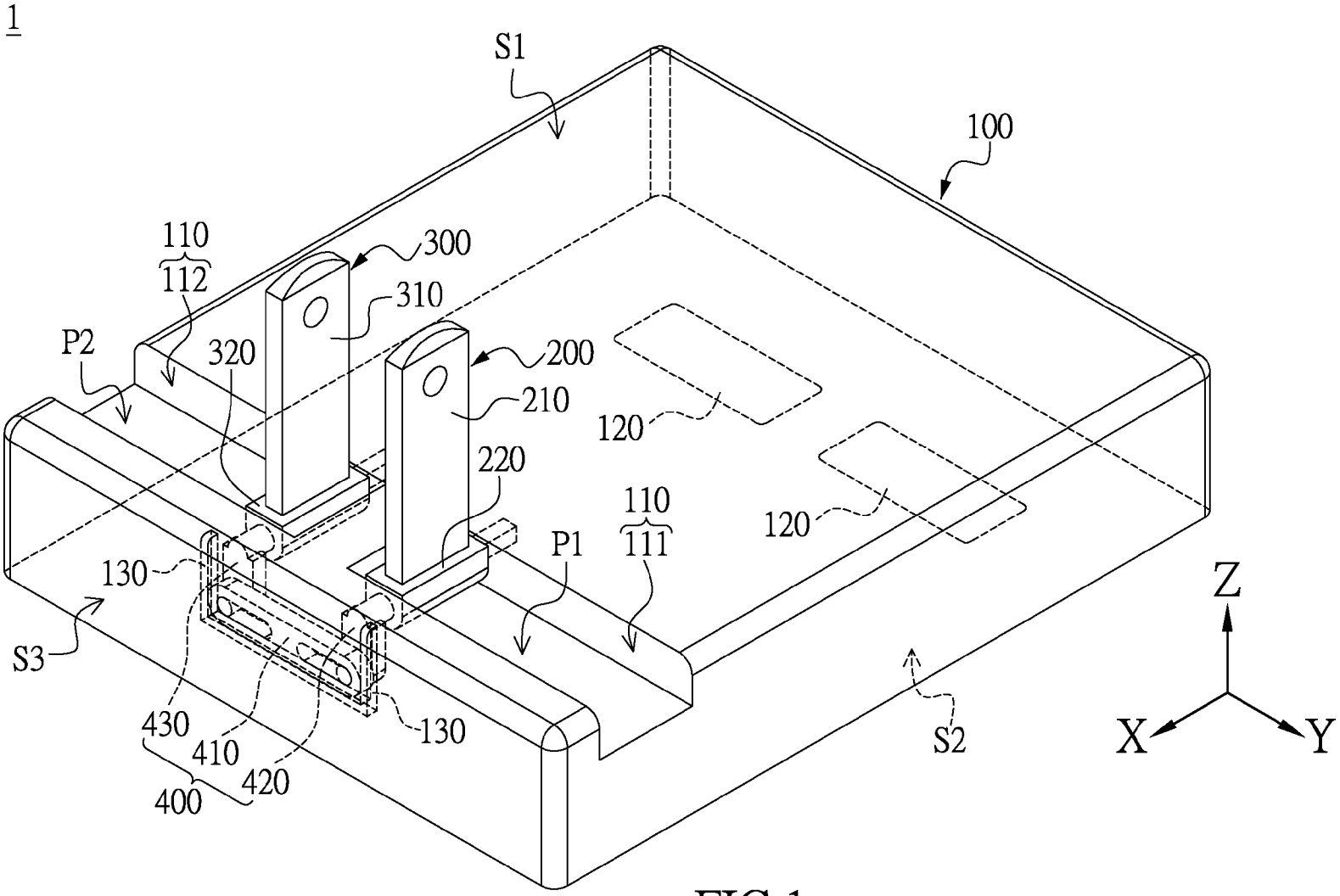
FIG. 1 shows a perspective view of a power plug device according to a first embodiment of the present disclosure.

FIG. 1 shows a perspective view of a power plug device according to a first embodiment of the present disclosure. The power plug device 1 includes a casing 100, a first prong 200, a second prong 300, and a linkage mechanism 400. The first prong 200 and the second prong 300 are each pivotally connected to the casing 100. The linkage mechanism 400 is disposed in the casing 100.

Figure 3A:
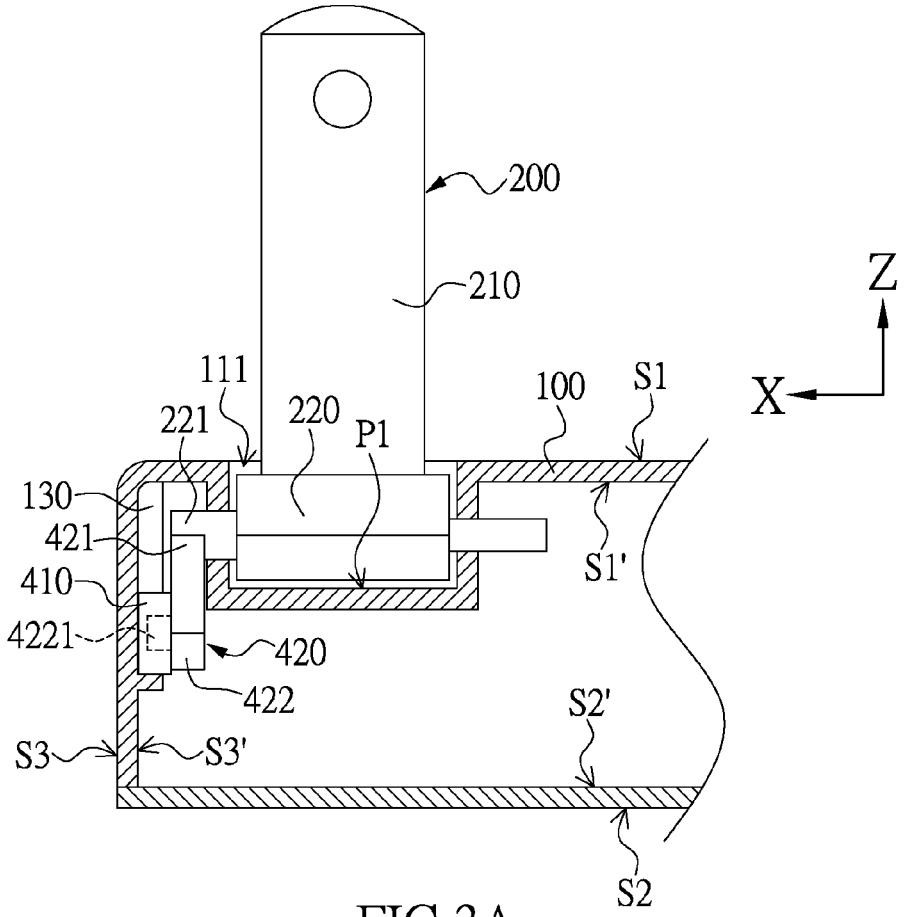
FIG. 3A and FIG. 3B show side views of the power plug device of FIG. 1 in different states of use.
Figure 3B:
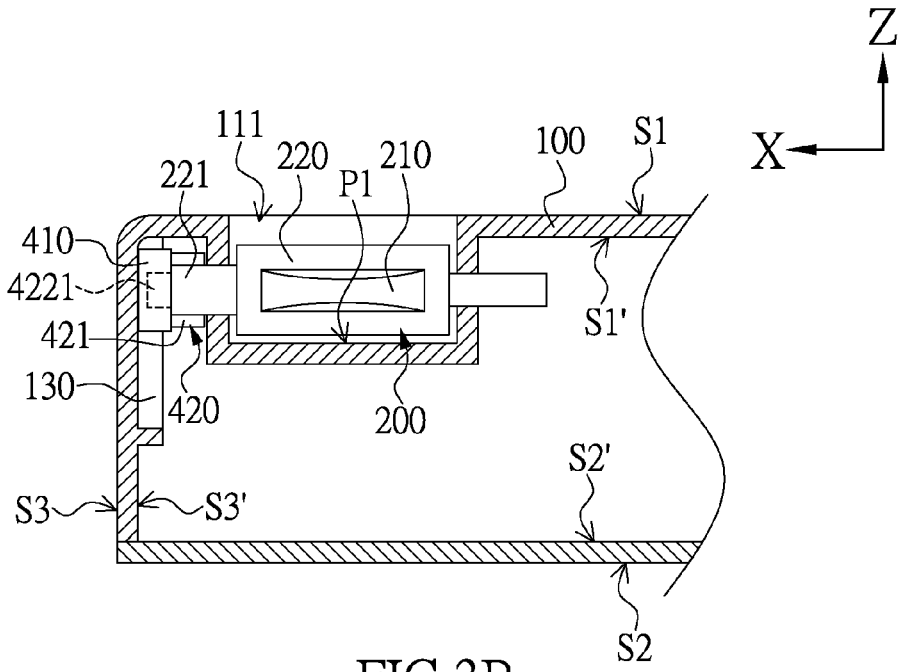

FIG. 3A and FIG. 3B show side views of the power plug device of FIG. 1 in different states of use. Please refer to FIG. 1, FIG. 3A and FIG. 3B. The overall shape of the casing 100 is that of a flat cuboid. The outer upper face S1 of the casing 100 is formed with a receiving recess 110. The shape of the receiving recess 110 corresponds to the shapes and dimensions of the first prong 200 and the second prong 300, such that the first prong 200 and the second prong 300 can be accommodated in the receiving recess 110. The receiving recess 110 includes a first recess 111 and a second recess 112. The first recess 111 accommodates the first prong 200, and the second recess 112 accommodates the second prong 300. In other embodiments, the first recess 111 and the second recess 112 can be connected.

The lower face S2 of the casing 100 is formed with two USB (Universal Serial Bus) slots 120. The USB slots 120 can be plugged by USB storage devices (not shown in the figures) such the USB is coupled to the power plug device 1. The casing 100 can also accommodate other units such as a charging circuit (not shown in the figures) such that the power plug device 1 becomes a lightweight electric charger. The first prong 200, the second prong 300 and the linkage mechanism 400 can be disposed at one side of the main body of the power plug device 1, and the charging circuit can be disposed in the remaining space of the main body.

Figure 2:
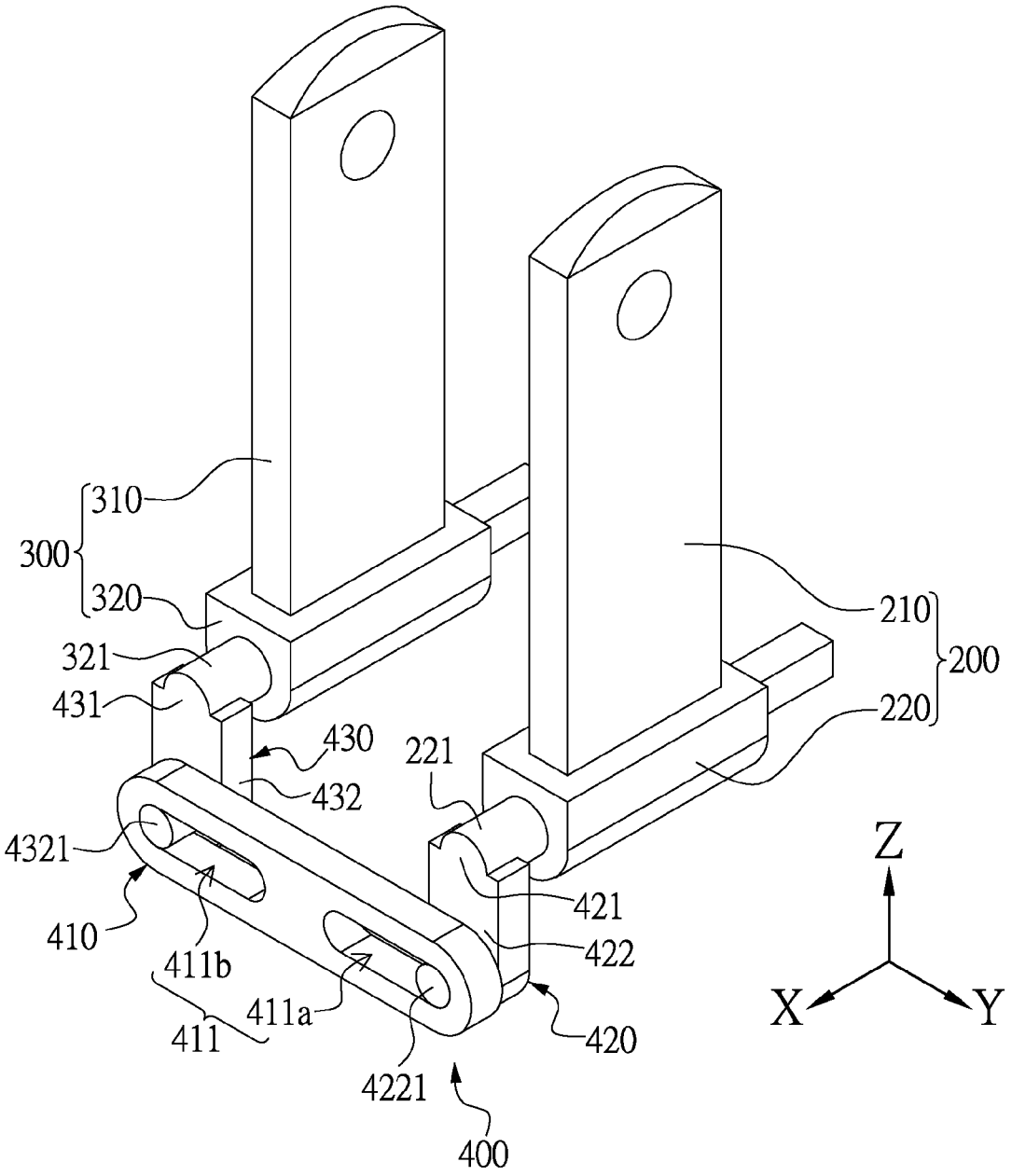
FIG. 2 shows a perspective view of a portion of the power plug device of FIG. 1.

FIG. 2 shows a perspective view of a portion of the power plug device of FIG. 1. The first prong 200 has a first electric transmission portion 210 and a first support portion 220 sleeving the base of the first electric transmission portion 210. The second prong 300 has a second electric transmission portion 310 and a second support portion 320 sleeving the base of the second electric transmission portion 310. The first electric transmission portion 210 and the second electric transmission portion 310 are for example electric conducting plates.

The first support portion 220 is pivotally connected in the first recess 111 through a first pivot shaft 221. The direction of extension of the first pivot shaft 221 is along the x-axis and is substantially perpendicular to the direction of extension of the first electric transmission portion 210. Similarly, the second support portion 320 is pivotally connected in the second recess 112 through a second pivot shaft 321. The direction of extension of the second pivot shaft 321 is along the x-axis and is substantially perpendicular to the direction of extension of the second electric transmission portion 310.

Figure 4:
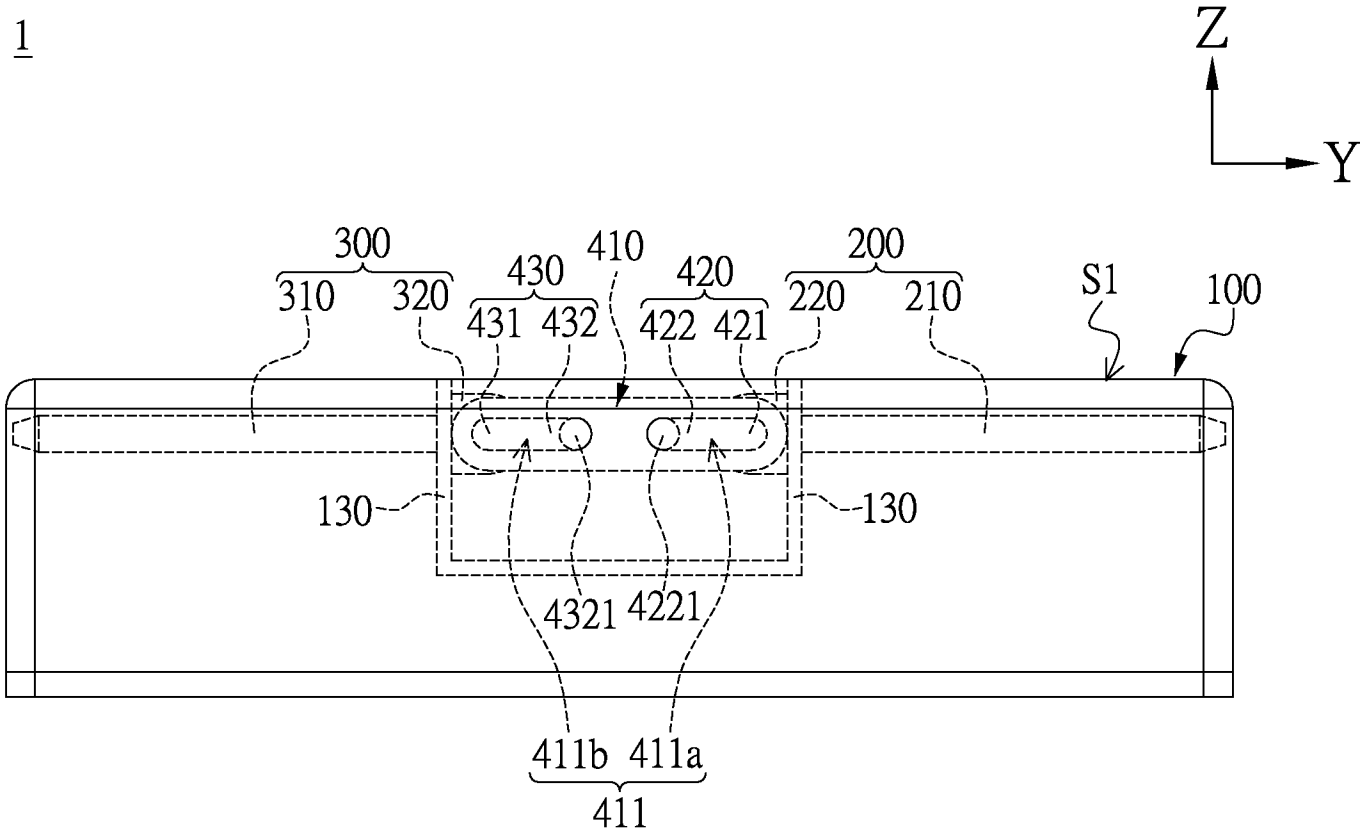
FIG. 4 shows a front view of the power plug device of FIG. 1.

FIG. 4 shows a front view of the power plug device of FIG. 1. The first support portion 220 can rotate about the first pivot shaft 221, such that the first prong 200 can rotate between a first position and a second position. When the first prong 200 rotates to the first position, the first prong 200 stands upright from the casing 100 and the first electric transmission portion 210 protrudes from the outer upper face S1 of the casing 100 along the direction of the z-axis. When the first prong 200 rotates to the second position, the first prong 200 is accommodated in the first recess 111 and the direction of extension of the first electric transmission portion 210 is substantially parallel to the bottom wall P1 of the first recess 111 (along the direction of the y-axis). As shown in the figures, the angle of rotation of the first prong 200 between the first position and the second position is for example at most ninety degrees. Similarly, the second support portion 320 can rotate about the second pivot shaft 321 such that the second prong 300 can rotate between its first position and second position.

The linkage mechanism 400 includes a linkage member 410, a first link 420 and a second link 430. The first prong 200 and the second prong 300 interact through the linkage mechanism 400. The linkage member 410 is overall rod-shaped, and has a guiding groove 411. As shown in FIG. 2, the guiding groove 411 includes unconnected a first sliding groove 411*a* and a second sliding groove 411*b*. As shown in FIG. 1 and FIG. 3A, the direction of extension of the guiding groove 411 is along the direction of the y-axis and is substantially the same to the direction of extension of the linkage member 410.

As shown in FIG. 1, the inner front face S3' of the casing 100 is formed with two protruding ribs arranged in parallel to serve as guiding rails 130 (the outer front face S3 and the inner front face S3' of the casing 100 are both substantially perpendicular to the outer upper face S1 of the casing 100). The direction of extension of these two ribs is along the direction of the z-axis. The distance between these two ribs corresponds to the dimension of the linkage member 410, such that the linkage member 410 can be arranged between these two ribs and slide in the direction of the z-axis. When the linkage member 410 slides in the casing 100 along the z-axis, the guiding rails 130 can guide the two ends of the linkage member 410 such that the direction of extension of the guiding groove 411 of the linkage member 410 is maintained along the direction of the y-axis.

A first end 421 of the first link 420 is fixed to the first pivot shaft 221, such that the first link 420 can rotate about an axis passing through the first end 421 inside the casing 100. A first end 431 of the second link 430 is fixed to the second pivot shaft 321, such that the second link 430 can rotate about an axis passing through the first end 431 inside the casing 100.

Referring to FIG. 3A and FIG. 3B, the first link 420 is positioned between the inner front face S3' and the first recess 111, and the second link 430 is positioned between the inner front face S3' and the second recess 112. The first link 420 and the second link 430 both lie in a same reference plane (not shown in the figures). The normal direction of the reference plane lies along the direction of the x-axis.

Referring to FIG. 2, a second end 422 of the first link 420 is formed with a protruding first restricting column 4221. The first restricting column 4221 is disposed in the first sliding groove 411*a*. Specifically, the first restricting column 4221 is slidably disposed in the first sliding groove 411*a*. Similarly, a second end 432 of the second link 430 is formed with a protruding second restricting column 4321. The second restricting column 4321 is slidably disposed in the second sliding groove 411*b*.

FIG. 1 and FIG. 3A show the first prong 200 and the second prong 300 at open positions, wherein the first prong 200 and the second prong 300 are at their respective first positions. FIG. 3B and FIG. 4 show the prong 200 and the second prong 300 at closed positions, where the first prong 200 and the second prong 300 are at their respective second positions. It is worth noting that since the first link 420 is fixed to the first prong 200, when the first prong 200 rotates, the direction of extension of the first link 420 stays the same throughout as the direction of extension of the first prong 200. Similarly, when the second prong 300 rotates, the direction of extension of the second link 430 stays the same throughout as the direction of extension of the second prong 300. When the first prong 200 rotates from its first position to its second position, the rotation of the first pivot shaft 221 drives the first link 420 to turn, which in turn drives the second end 422 of the first link 420 to slide along the first sliding groove 411*a* toward the middle of the linkage member 410, such that the first link 420 drives the linkage member 410 to move upward along the direction of the z-axis.

The upward motion of the linkage member 410 (in the positive direction of the z-axis) drives the second restricting column 4321 to slide along the second sliding groove 411*b* toward the middle of the linkage member 410, which in turn drives the second link 430 to turn. The second restricting column 4321 slides in the opposite direction as the first restricting column 4221 does, and the second link 430 turns in the opposite direction as the first link 420 does. Therefore, the first end 431 of the second link 430 can drive the second pivot shaft 321 to rotate in the opposite direction as the first pivot shaft 221 does, such that the second prong 300 rotates in the opposite direction as the first prong 200 does, and the second prong 300 rotates from its first position to its second position.

Conversely, when the first prong 200 turns about the casing 100 and rotates from its second position to its first position, the downward motion of the linkage member 410 drives the second prong 300 to rotate in the opposite direction as the first prong 200 does, and the second prong rotates from its second position to its first position.

In summary, when the first prong 200 rotates, the turning of the first link 420 can drive the linkage member 410 to move along the direction of the z-axis, which in turn drives the second link 430 to turn, such that the second prong 300 and the first prong 200 rotate in opposite directions. By this configuration, the user can raise or lower one of the prongs (e.g. the first prong 200) to cause the other prong (e.g. the second prong 300) to be raised or lowered as well.

In another embodiment, the bottom wall P1 of the first recess 111 can be formed with a first latch hole at a position corresponding to the tip of the first prong 200, and the bottom wall P2 of the second recess 112 can be formed with a second latch hole at a position corresponding to the tip of the second prong 300, the tip of the first prong 200 is formed with a first protrusion, and the tip of the second prong 300 is formed with a second protrusion. When the first prong 200 rotates to its first position, the first protrusion latches to the first latch hole such that the first prong 200 is retained at the first position. When the second prong 300 rotates to its first position, the second protrusion latches to the second latch hole such that the second prong 300 is retained at the first position.

The following details other embodiments of the power plug device 1 and the linkage mechanism 400 thereof according to the present disclosure. The similar features of the following embodiments are not further described.

Second Embodiment

Figure 5:
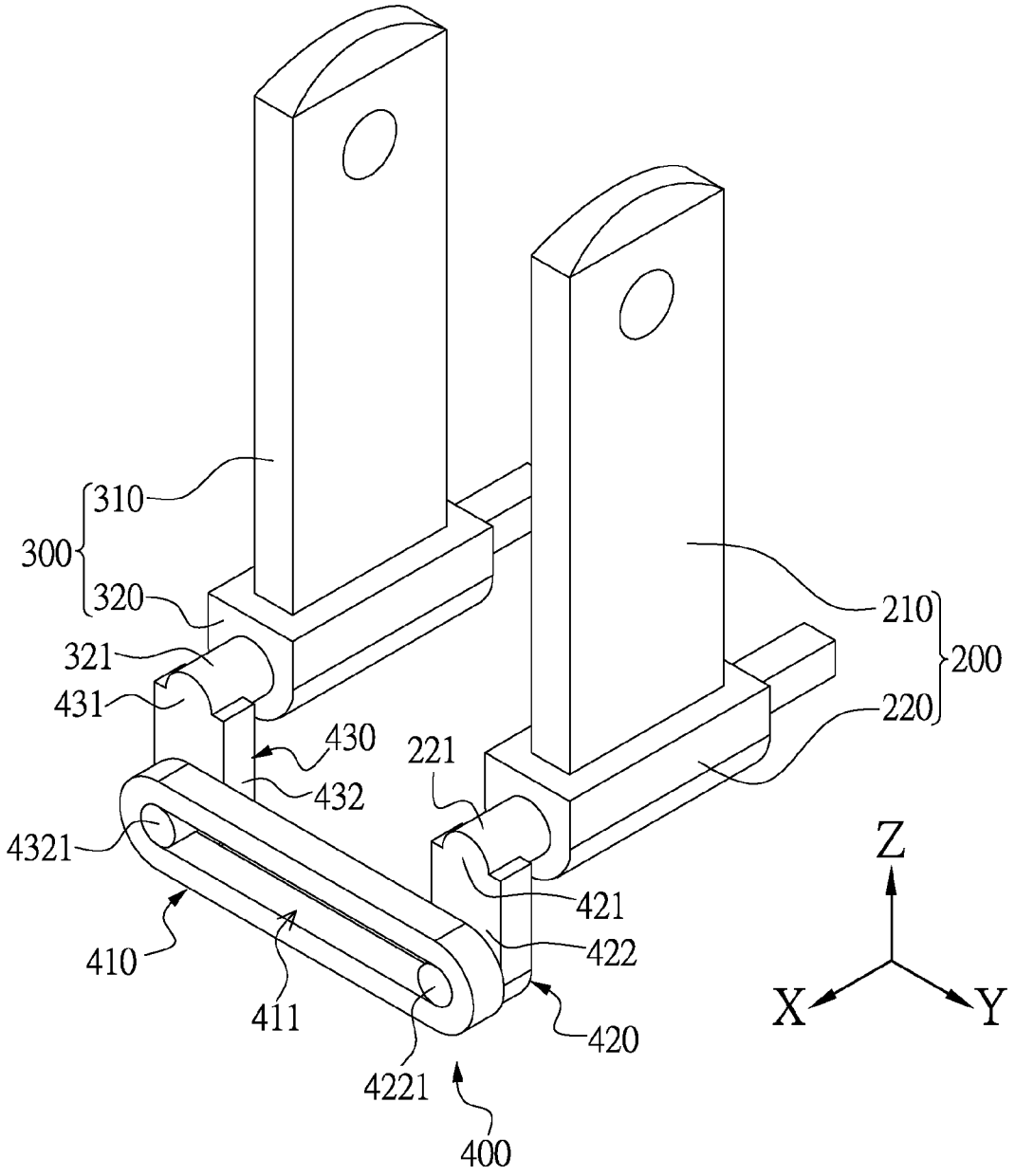
FIG. 5 shows a perspective view of a portion of a power plug device according to a second embodiment of the present disclosure.

FIG. 5 shows a perspective view of a portion of a power plug device according to a second embodiment of the present disclosure. The first sliding groove 411*a* and the second sliding groove 411*b* (refer to FIG. 2) are connected in the present embodiment. In other words, the guiding groove 411 of the present embodiment is formed by a single straight sliding groove.

When the first prong 200 and the second prong 300 are at their respective first positions, the first restricting column 4221 and the second restricting column 4321 are respectively positioned at two ends of the guiding groove 411. When the first prong 200 and the second prong 300 are at their respective second positions, the first restricting column 4221 and the second restricting column 4321 are positioned at the middle of the guiding groove 411 and abut each other, thereby the first restricting column 4221 and the second restricting column 4321 block and restrict the movement of each other, such that the first prong 200 and the second prong 300 through the linkage mechanism 400 cannot continue to rotate.

Third Embodiment

Figure 6:
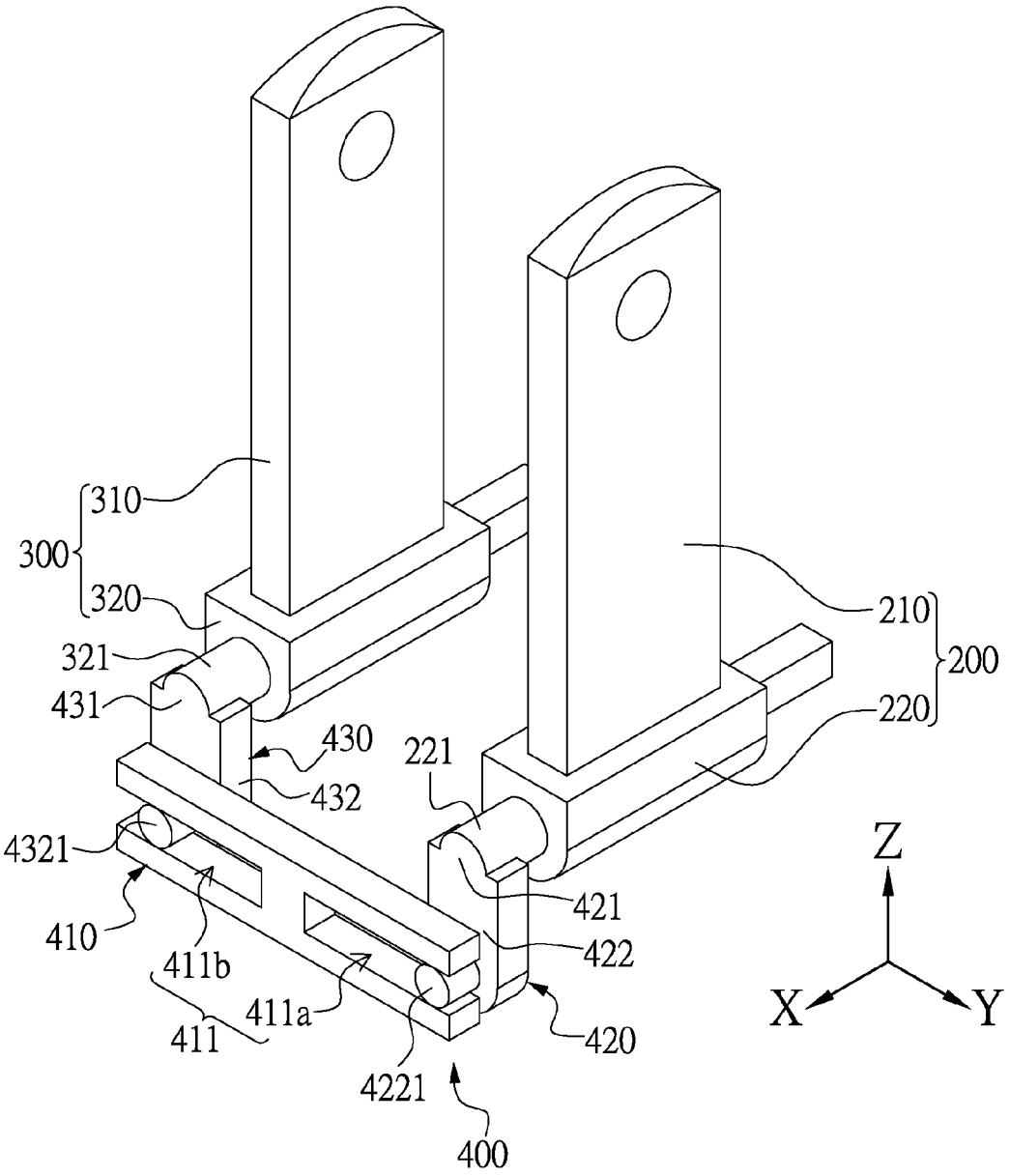
FIG. 6 shows a perspective view of a portion of a power plug device according to a third embodiment of the present disclosure.

FIG. 6 shows a perspective view of a portion of a power plug device according to a third embodiment of the present disclosure. One end of the first sliding groove 411*a* can open to a side of the linkage member 410, and one end of the second sliding member 411*b* can open to a side of the linkage member 410. In other words, the first sliding groove 411*a* and the second sliding groove 411*b* are grooves opening respectively at two sides of the linkage member 410, and the linkage member 410 is substantially H-shaped.

Fourth Embodiment

Figure 7:
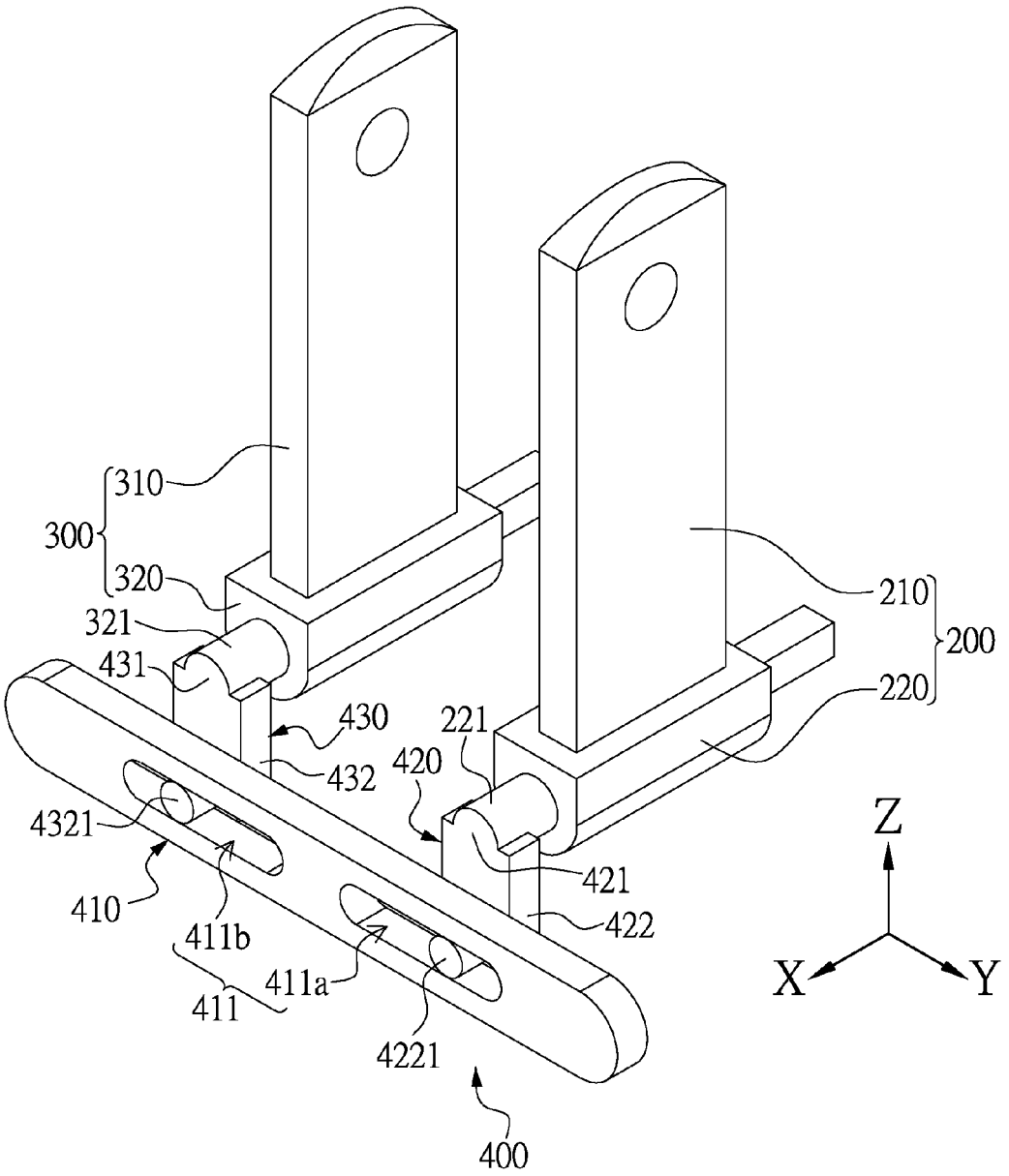
FIG. 7 shows a perspective view of a portion of a power plug device according to a fourth embodiment of the present disclosure.

FIG. 7 shows a perspective view of a portion of a power plug device according to a fourth embodiment of the present disclosure. The distance between the first end 421 of the first link 420 and the first end 431 of the second link 430 is smaller than the length of the linkage member 410 (namely, the distance between the two ends of the linkage member 410). By this configuration, when the linkage member 410 moves inside the casing 100 along the direction of the z-axis, the dimension of the linkage member 410 assists in balancing the linkage member 410 such that the direction of extension of the guiding groove 411 of the linkage member 410 can be kept along the direction of the y-axis.

Fifth Embodiment

Figure 8:
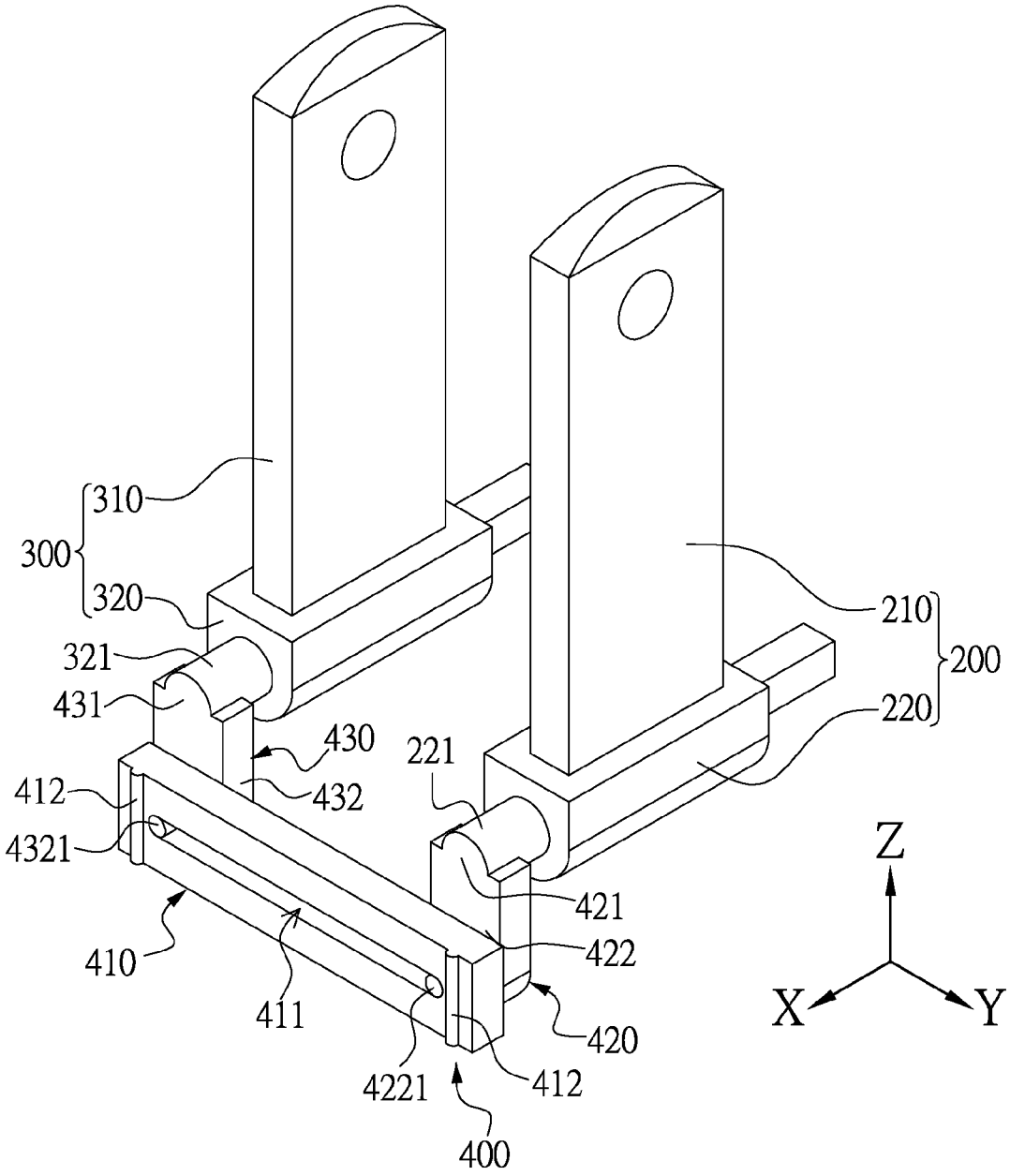
FIG. 8 shows a perspective view of a portion of a power plug device according to a fifth embodiment of the present disclosure.

FIG. 8 shows a perspective view of a portion of a power plug device according to a fifth embodiment of the present disclosure. The linkage member 410 is formed with two protruding portions 412 arranged in parallel. The protruding portions 412 each extend in the direction along the z-axis, and can slide along the direction of the z-axis along the guiding rails 130. When the linkage member 410 slides up and down inside the casing 100, the protruding portions 412 maintains the linkage member 410 to move in the direction of the z-axis, such that the direction of extension of the guiding groove 411 is kept along the direction of the y-axis. In another embodiment, the linkage member 410 can have only one protrusion portion 412 arranged at the middle of the linkage member 410.

Sixth Embodiment

Figure 9A:
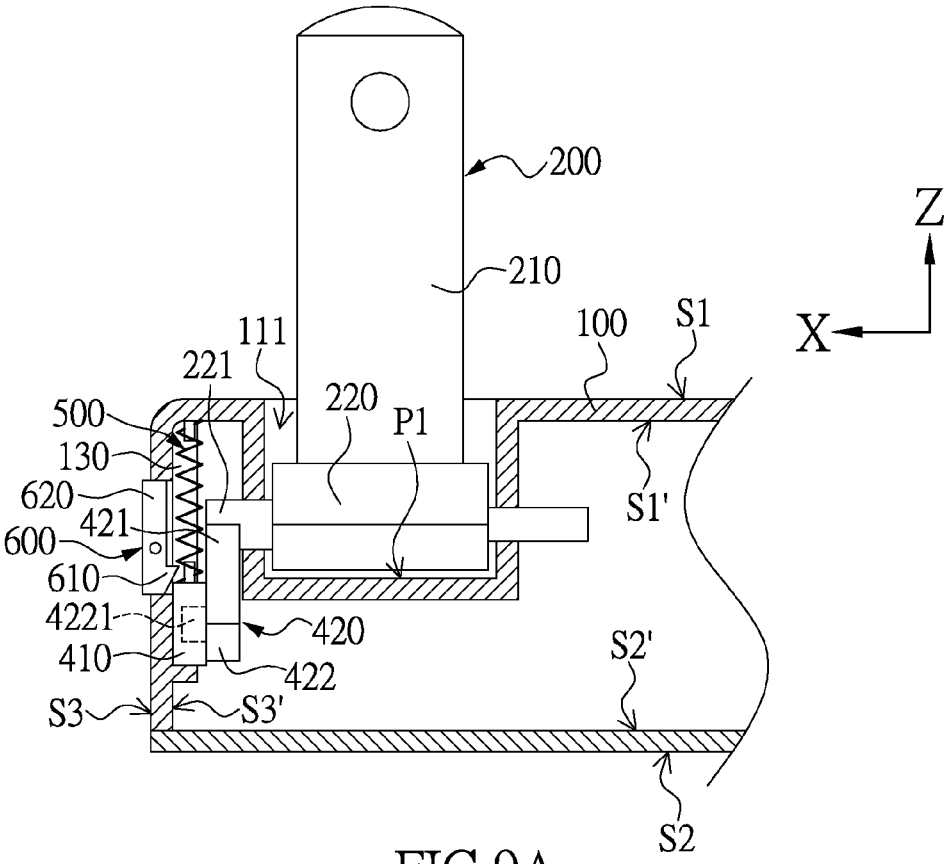
FIG. 9A and FIG. 9B show side views of a power plug device in different states of use according to a sixth embodiment of the present disclosure.
Figure 9B:
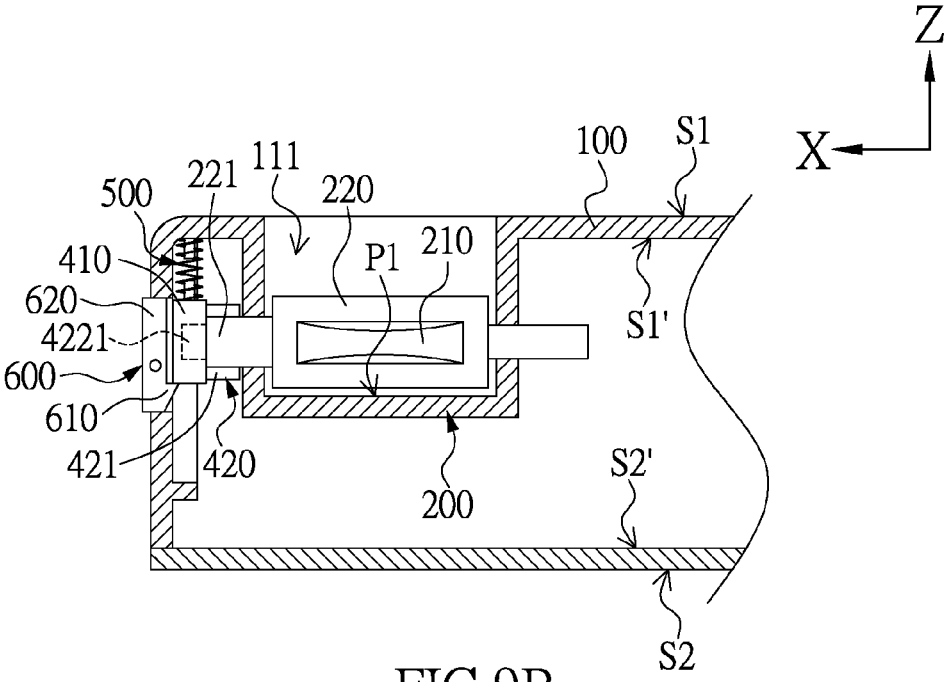

FIG. 9A and FIG. 9B show side views of a power plug device in different states of use according to a sixth embodiment of the present disclosure. The linkage member 410 is connected to an inner upper wall S1' of the casing 100 through an elastic unit 500 (e.g. a spring), and a push block 600 can be disposed through the casing 100. The push block 600 is pivoted about the casing 100 and is between the outer front face S3 and the inner front face S3'. A first end 610 of the push block 600 protrudes from the inner front face S3' of the casing 100 and is positioned along the path of motion of the linkage member 410. A second end 620 of the push block is exposed at the outer front face S3 of the casing 100.

When the first prong 200 rotates from its first position to its second position, the linkage member 410 can move along the z-axis upward and compress the elastic unit 500, and the linkage member 410 can move above the first end 610 of the push block 600. At this moment, the first end 610 protruding from the inner front face S3' restricts the downward motion of the linkage member 410 along the z-axis. By this configuration, the push block 600 can retain the first prong 200 and the second prong 300 at their respective second positions.

When the user pushes the second end 620 of the push block 600 into the casing 100, the first end 610 of the push block 600 departs from the path of motion of the linkage member 410 and disengages the linkage member 410, and the elastic force provided by the elastic unit 500 drives the linkage member 410 do move downward along the z-axis, which in turn drives the first prong 200 and the second prong 300 to rotate from their respective second positions to their respective first positions.

Seventh Embodiment

Figure 10:
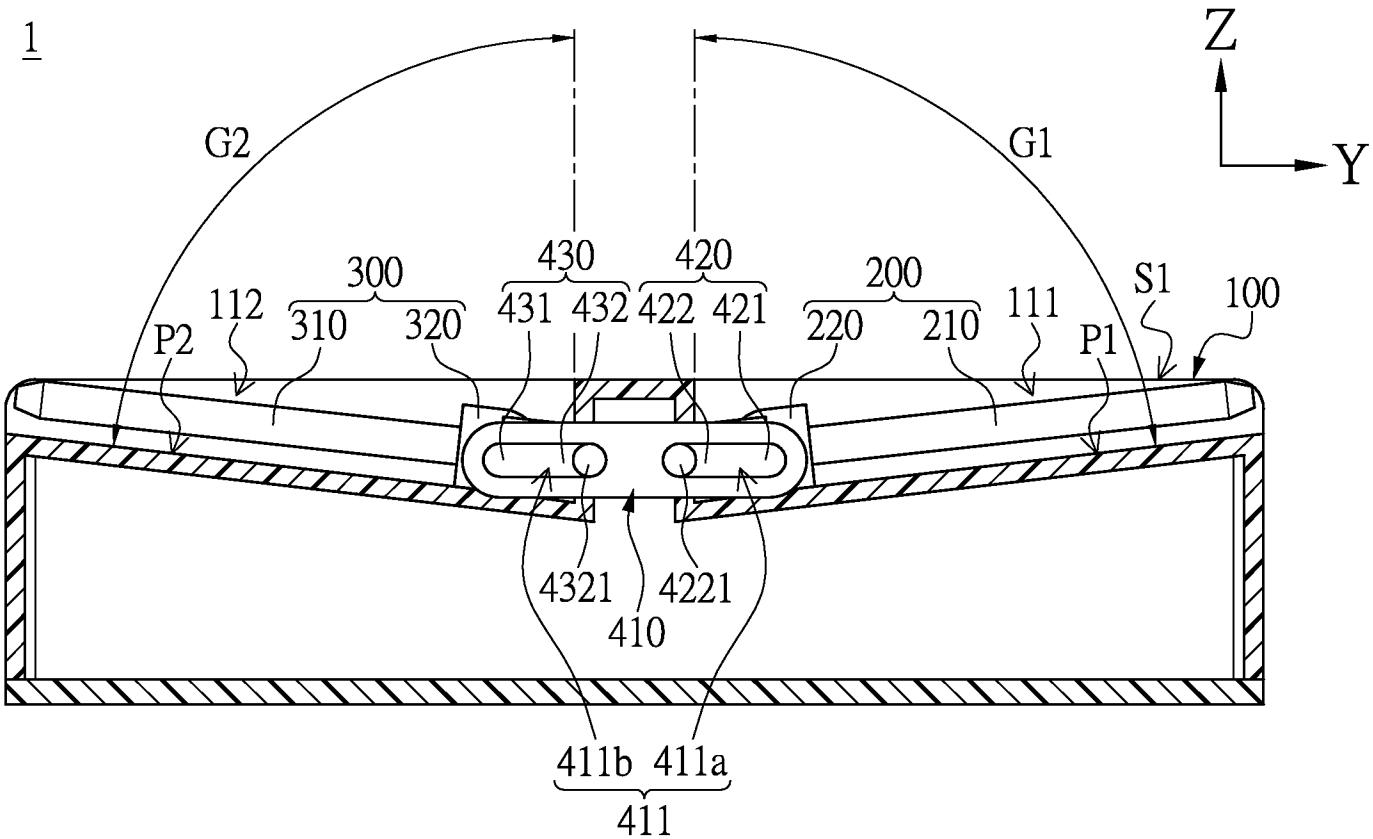
FIG. 10 shows a front view of a power plug device according to a seventh embodiment of the present disclosure.

FIG. 10 shows a front view of a power plug device according to a seventh embodiment of the present disclosure. The bottom wall P1 of the first recess 111 and the direction normal to the outer upper face S1 have a first included angle G1 therebetween. The first included angle G1 is smaller than 90 degrees. The bottom wall P2 of the second recess 112 and the direction normal to the outer upper face S1 have a second included angle G2 therebetween. The second included angle G2 is smaller than 90 degrees. In other words, the bottom of the first recess 111 and the bottom of the second recess 112 each can be a slanted face. When the first prong 200 is positioned at its second position, the direction of extension of the first prong 200 and the direction normal to the outer upper face S1 have an included angle therebetween which is smaller than 90 degrees. Thus, the angle of rotation between the first position and the second position of the first prong 200 can be smaller than 90 degrees. Similarly, the angle of rotation between the first position and the second position of the second prong 300 can be smaller than 90 degrees. By this configuration, when the first prong 200 and the second prong 300 rotate between their respective first positions and second positions, the range of motion of the linkage member 410 along the direction of the z-axis can be reduced.

Eighth Embodiment

Figure 11:
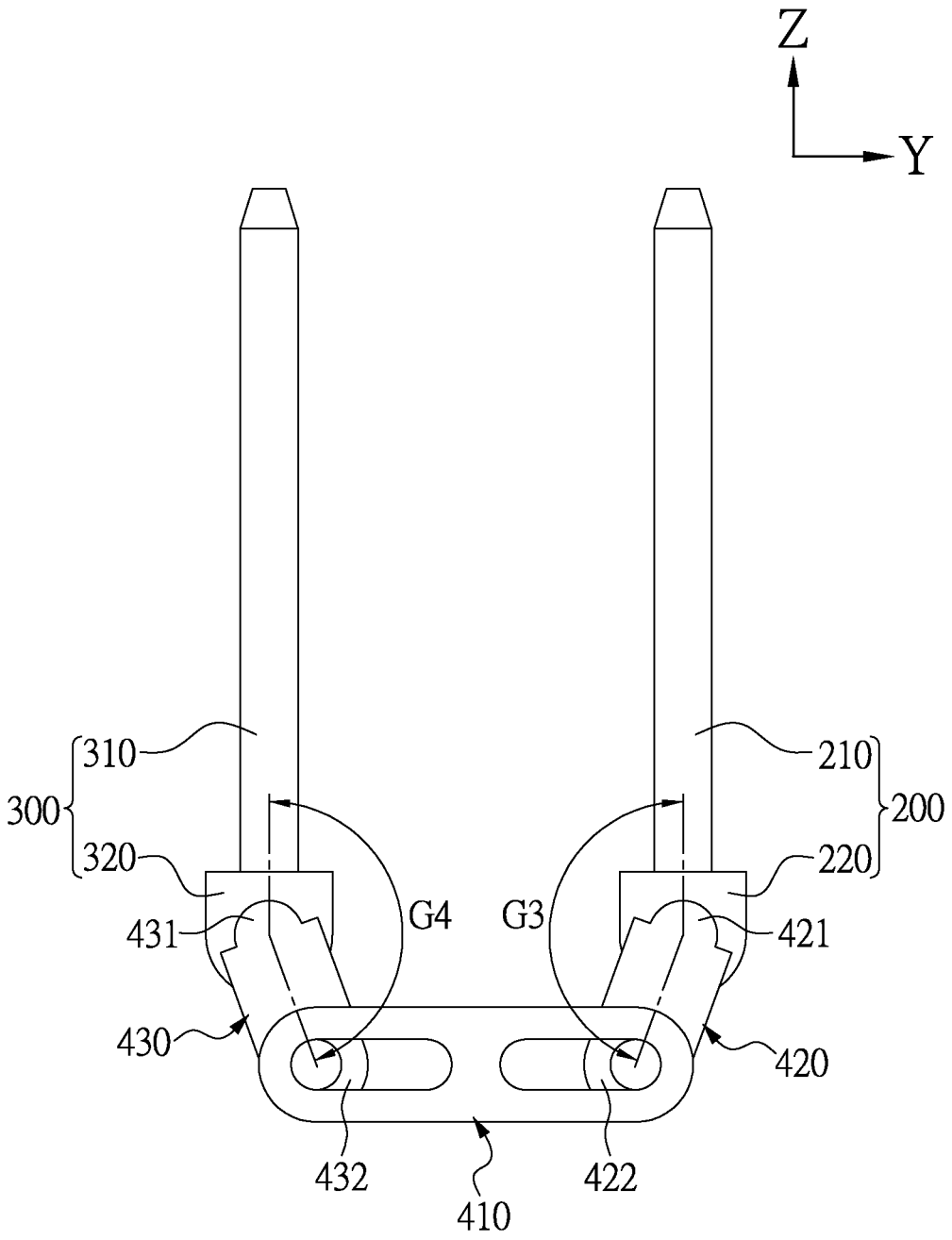
FIG. 11 shows a front view of a portion of a power plug device according to an eight embodiment of the present disclosure.

FIG. 11 shows a front view of a portion of a power plug device according to an eight embodiment of the present disclosure. The distance between the first end 421 of the first link 420 and the first end 431 of the second link 430 is greater than the maximum distance between the second end 422 of the first link 420 and the second end 432 of the second link 430. In other words, the direction of extension of the first prong 200 and the direction of extension of the first link 420 have a third included angle G3 therebetween which is not 180 degrees. So, when the first prong 200 rotates between its first position and second position, the angle of rotation of the first link 420 can be smaller than 90 degrees. The direction of extension of the second prong 300 and the direction of extension of the second link 430 have a fourth included angle G4 therebetween which is not 180 degrees. When the second prong 300 rotates between its first position and second position, the angle of rotation of the second link 430 can be smaller than 90 degrees. By this configuration, when the first prong 200 and the second prong 300 rotate between their respective first positions and second positions, the range of the up and down motion of the linkage member 410 along the z-axis can be reduced.

Ninth Embodiment

Figure 12:
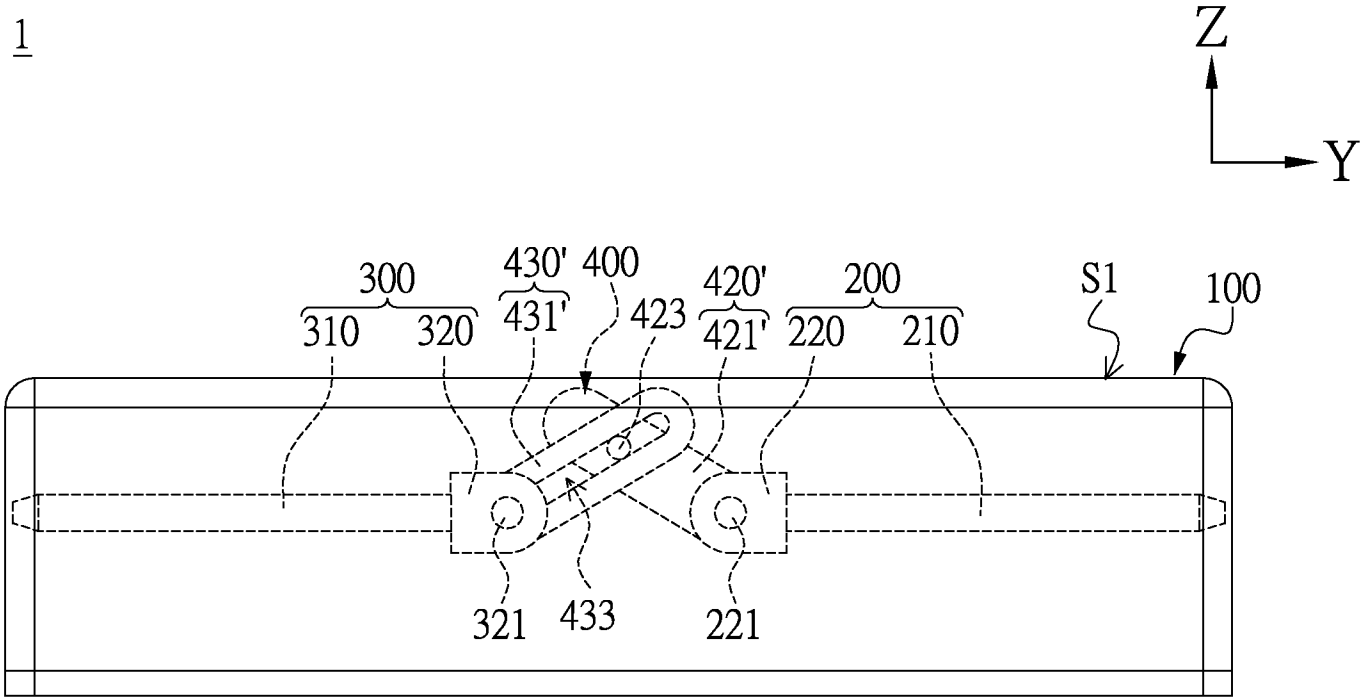
FIG. 12 shows a front view of a power plug device according to a ninth embodiment of the present disclosure.

FIG. 12 shows a front view of a power plug device according to a ninth embodiment of the present disclosure. The linkage mechanism 400 includes a first link 420' and a second link 430', and no linkage member 410. The first prong 200 and the second prong 300 are mutually connected through the first link 420'. A first end 421' of the first link 420' is fixed to the first pivot shaft 221. The midsection of the first link 420' is formed with a protruding third restricting column 423. A first end 431' of the second link 430' is fixed to the second pivot shaft 321. The second link 430' is formed with a guiding groove 433. The direction of extension of the guiding rove 433 is substantially the same as the direction of extension of the second link 430'. The third restricting column 423 is slidably disposed in the guiding groove 433.

When the first prong 200 rotates from its second position to its first position, the first link 420' is driven to turn, which causes the third restricting column 423 to slide in the guiding groove 322 toward the first end 431' of the second link 430', which in turn drives the second link 430' to turn in the opposite direction as the first link 420' does, such that the second prong 300 rotates in the opposite direction as the first prong 200 does.

Tenth Embodiment

Figure 13:
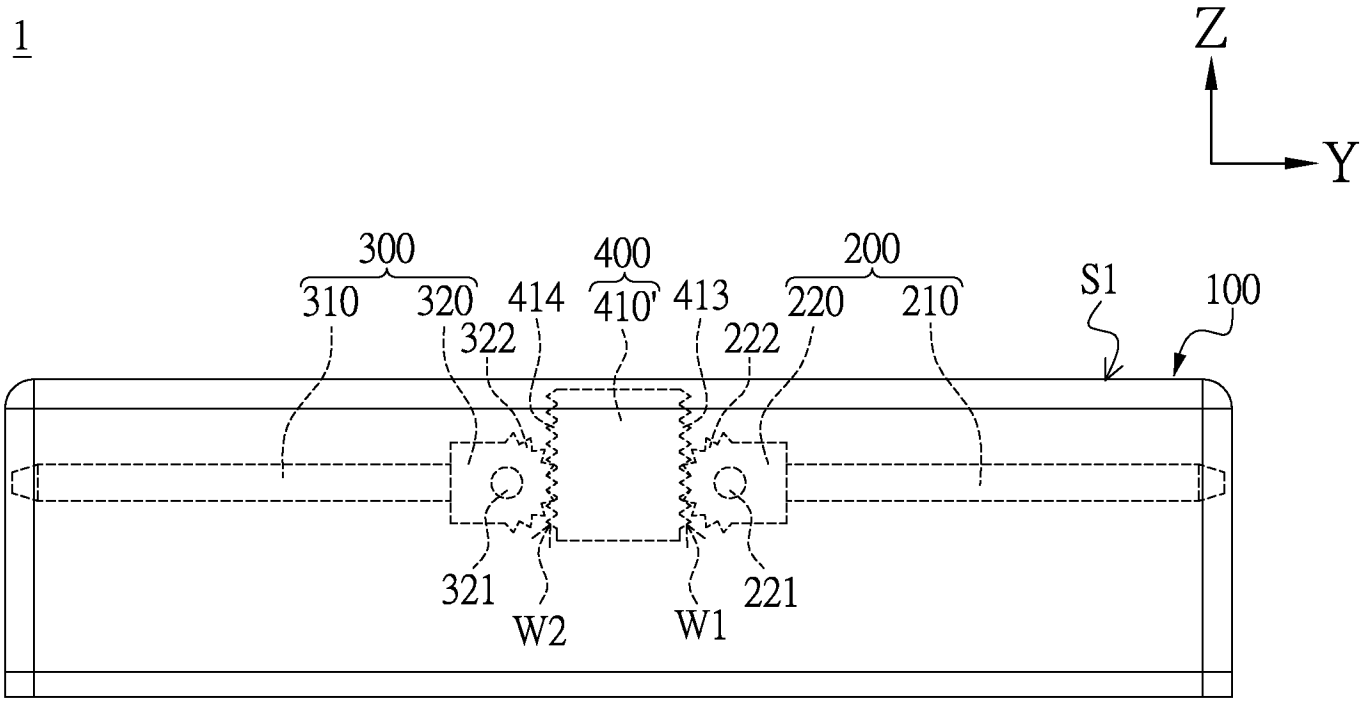
FIG. 13 shows a front view of a power plug device according to a tenth embodiment of the present disclosure.

FIG. 13 shows a front view of a power plug device according to a tenth embodiment of the present disclosure. The underside of the first support portion 220 and the underside of the second support portion 320 each have a plurality of first cut teeth 222, 322. The linkage mechanism 400 merely includes a linkage member 410' positioned between the first support portion 220 and the second support portion 320. The linkage member 410' can be a rack. The linkage member 410' has a first face W1 and a second face W2 opposite the first face W1. The first cut teeth 222 at the underside of the first support portion 220 can mesh with a plurality of second cut teeth 413 arranged at the first face W1. The first cut teeth 322 at the underside of the second support portion 320 can mesh with a plurality of second cut teeth 414 arranged at the second face W2. When the first prong 200 turns about the casing 100, through the mesh of the first cut teeth 222, 322 to the respective second cut teeth 413, 414, the linkage member 410' is driven up and down along the direction of the z-axis, such that the first prong 200 and the second prong 300 rotate in opposite directions.

In summary of the above, the power plug device 1 of the present disclosure applies the linkage mechanism 400 such that when the first prong 200 rotates, the first link 420 turns and drives the linkage member 410 to move up and down, which in turn drives the second link 430 to turn, such that the second prong 300 rotates in the opposite direction as the first prong 200 does. By this configuration, the user can raise or lower one of the prongs to cause the other prong to be also raised or lowered. Additionally, the simple design of the linkage mechanism 400 reduces the volume occupied by the linkage mechanism 400.

The descriptions illustrated supra set forth simply the preferred embodiments of the present disclosure; however, the characteristics of the present disclosure are by no means restricted thereto. All changes, alternations, or modifications conveniently considered by those skilled in the art are deemed to be encompassed within the scope of the present disclosure delineated by the following claims.

What is claimed is:

1. A power plug device, comprising:

a casing, an outer face of the casing formed with a receiving recess;

a first prong and a second prong, the first prong and the second prong each pivotally arranged in the receiving recess respectively through pivotal connections between the bottom end of the first prong and the casing and between the bottom end of the second prong and the casing, and a linkage mechanism disposed inside the casing, the linkage mechanism comprising:

a linkage member having a guiding groove;

a first link, a first end of the first link being fixed to the bottom end of the first prong, and a second end of the first link being disposed in the guiding groove; and a second link, a first end of the second link being fixed to the bottom end of the second prong, and a second end of the second link being disposed in the guiding groove; wherein when the first prong rotates relative to the casing, the second end of the first link slides in the guiding groove, the linkage member is driven to move, and the second end of the second link is in turn driven to slide in the guiding groove in the opposite direction as the second end of the first link slides, causing the second prong to rotate in the opposite direction as the first prong does.

2. The power plug device according to claim 1, wherein the distance between the first end of the first link and the first end of the second link is greater than a maximum distance between the second end of the first link and the second end of the second link.

3. The power plug device according to claim 1, wherein the distance between the first end of the first link and the first end of the second link is smaller than the length of the linkage member.

4. The power plug device according to claim 1, wherein a bottom wall of the receiving recess and the direction normal to the outer face of the casing have an included angle, and the included angle is smaller than 90 degrees.

5. The power plug device according to claim 1, wherein the casing is formed with a USB slot.

6. The power plug device according to claim 1, wherein an inner face of the casing has a sliding rail, the linkage member is slidably disposed at the sliding rail, the sliding rail extends in a first direction, and the guiding groove extends in a second direction.

7. The power plug device according to claim 6, wherein the first direction is perpendicular to the second direction.

8. The power plug device according to claim 6, wherein the linkage member is connected to the casing through an elastic unit, a push block is disposed through the casing, a first end of the push block protrudes from an inner face of the casing and is positioned along the path of motion of the linkage member, and a second end of the push block is exposed at an outer face of the casing.

9. A linkage mechanism for a power plug device, the power plug device having a casing, a first prong and a second prong, an outer face of the casing formed with a receiving recess, the first prong and the second prong each pivotally arranged in the receiving recess respectively through pivotal connections between the bottom end of the first prong and the casing and between the bottom end of the second prong and the casing, the linkage mechanism disposed inside the casing, the linkage mechanism comprising:

a linkage member having a guiding groove;

a first link, a first end of the first link being fixed to the bottom end of the first prong, and a second end of the first link being disposed in the guiding groove; and a second link, a first end of the second link being fixed to the bottom end of the second prong, and a second end of the second link being disposed in the guiding groove; wherein the distance between the first end of the first link and the first end of the second link is greater than a maximum distance between the second end of the first link and the second end of the second link;

when the first prong rotates relative to the casing, the second end of the first link slides in the guiding groove, the linkage member is driven to move, and the second end of the second link is in turn driven to slide in the guiding groove in the opposite direction as the second end of the first link slides, causing the second prong to rotate in the opposite direction as the first prong does.

10. The linkage mechanism according to claim 9, wherein an inner face of the casing has a sliding rail, the linkage member is slidably disposed at the sliding rail, the sliding rail extends in a first direction, and the guiding groove extends in a second direction.

11. A power plug device, comprising:

a casing, an outer face of the casing formed with a receiving recess, and an inner face of casing has a sliding rail;

a first prong and a second prong, the first prong and the second prong each pivotally arranged in the receiving recess respectively through pivotal connections between the bottom end of the first prong and the casing and between the bottom end of the second prong and the casing, and a linkage mechanism disposed inside the casing, the linkage mechanism comprising:

a linkage member having a guiding groove and slidably disposed at the sliding rail, wherein the sliding rail extends in a first direction, and the guiding groove extends in a second direction, and the first direction is perpendicular to the second direction;

a first link, a first end of the first link being fixed to the bottom end of the first prong, and a second end of the first link being disposed in the guiding groove; and a second link, a first end of the second link being fixed to the bottom end of the second prong, and a second end of the second link being disposed in the guiding groove; wherein when the first prong rotates relative to the casing, the second end of the first link slides in the guiding groove, the linkage member is driven to move, and the second end of the second link is in turn driven to slide in the guiding groove in the opposite direction as the second end of the first link slides, causing the second prong to rotate in the opposite direction as the first prong does.

* * * * *